US007067225B2

(12) United States Patent
Watanabe et al.

(10) Patent No.: US 7,067,225 B2
(45) Date of Patent: Jun. 27, 2006

(54) METHOD FOR FORMING AN IMAGE

(75) Inventors: Shuntaro Watanabe, Shizuoka (JP); Yushi Mikuriya, Shizuoka (JP); Takeshi Yamamoto, Kanagawa (JP); Shinya Yachi, Shizouka (JP); Katsuyuki Nonaka, Ibaraki (JP)

(73) Assignee: Canon Kabushiki Kaisha (JP)

( * ) Notice: Subject to any disclaimer, the term of this patent is extended or adjusted under 35 U.S.C. 154(b) by 296 days.

(21) Appl. No.: 10/753,058

(22) Filed: Jan. 7, 2004

(65) Prior Publication Data

US 2004/0191665 A1 Sep. 30, 2004

(30) Foreign Application Priority Data

Jan. 8, 2003 (JP) ..... 2003-002076

(51) Int. Cl.
*G03G 15/16* (2006.01)

(52) U.S. Cl. ..... 430/124; 430/126; 399/281; 399/284; 399/279; 399/286

(58) Field of Classification Search ..... 430/126, 430/124; 399/279, 281, 284, 286
See application file for complete search history.

(56) References Cited

U.S. PATENT DOCUMENTS 5,640,651 A * 6/1997 Katoh et al. ..... 399/281
2002/0106575 A1* 8/2002 Akashi et al. ..... 430/125
2004/0165914 A1* 8/2004 Haraguchi et al. ..... 399/279

FOREIGN PATENT DOCUMENTS

JP 06130792 A * 5/1994

* cited by examiner

*Primary Examiner*—Christopher Rodee
(74) *Attorney, Agent, or Firm*—Rossi, Kimms & McDowell, LLP

(57) ABSTRACT

To provide an method for forming an image capable of effectively suppressing a toner from deteriorating and also capable of keeping the quality of an image for a long period of time, even when the method is applied to an apparatus with as high process speed. The prevent invention provides an method for forming an image, in which a developing unit is used, which includes: a rotatable cylindrical toner bearing member having a diameter represented as Rd (mm); and a rotatable cylindrical toner-supplying member having a diameter Rs (mm), the diameters Rd and Rs satisfying the following relational expression (1):

$$1 \leqq Rs - Rd \leqq 10 \quad (1)$$

and in which the nonmagnetic one-component toner having an degree of aggregation of 5 to 30% and an electric resistivity of $1\times10^{14}$ to $1\times10^{18}$ Ω·cm at an electric field of $1\times10^{4}$ V/cm is used.

7 Claims, 3 Drawing Sheets

METHOD FOR FORMING AN IMAGE

BACKGROUND OF THE INVENTION

1. Field of the Invention

The present invention relates to a method for forming an image using an electrophotographic technology.

2. Description of the Related Art

In recent years, the spread of a copying machine and a printer using electrophotography requires further improvements thereof in terms of speed-up, downsizing, full-colorization, and a high image quality. In addition, as the user thereof expands, the lower priced copying machines and printers and improved maintenance-free abilities thereof have also been demanded. Therefore, as regards the main body of each of those machines, the number of structural components should be decreased and also the machine configuration should be simplified.

Consequently, technical requirements for consumable supplies such as a toner and a drum have increased in year after year. In addition, as a developing method, attention is directed toward a contact developing method using a nonmagnetic one-component developer.

A toner particle in a nonmagnetic one-component developer is more excellent in fixing ability at low temperature than a magnetic toner. In addition, such a developer does not contain an opaque magnetic material, so that the developer is suitable for obtaining a color image such as a full- or multiple-color image and can be used with a light-transmitting medium such as an overhead transparency film (i.e., an OHP film). Furthermore, one of the features of such a consumable developer is its simple structure, so that the machine can be downsized and maintenance-free.

As stated above, the nonmagnetic one-component developing method is a very suitable for attaining various kinds of requirements such as downsizing the machine, making the machine maintenance-free, making an image of much finer resolution, and providing a full-color image.

For meeting the requirement of downsizing the image forming apparatus using an electrophotographic system, such as a copying machine, a printer, or a facsimile machine, there is a tendency of reducing diameters of a toner bearing member and a toner-supplying member for supplying a toner to the toner bearing member. Furthermore, there is an additional requirement for speeding up, so that an extremely high process speed is required when trying to obtain the downsized and high-speed machine. Thus, the toner bearing member and the toner-supplying member need to rotate at high speed. At this time, a rub between the toner-supplying member and the toner bearing member and a rub between the toner bearing member and a toner regulating member accelerate toner deterioration. Consequently, the toner deterioration leads to a decrease in developing ability of the toner, resulting in poor quality ability of an image to be formed.

On the other hand, there is proposed a technology for increasing the durability of electric charges retained on the toner and environmental stability thereof by specifying the electric resistivity of the nonmagnetic one-component developer (see JP 07-43546 B). In addition, there is also proposed a technology to suppress a decrease in quality of an image by controlling the degree of aggregation of a toner in the nonmagnetic one-component development (see Japanese Patent No. 3272056).

Furthermore, for suppressing the deterioration of a toner-supplying roller, there is proposed a technology to make the diameter of the toner-supplying roller larger than that of a developing roller (see JP 05-257376 A). In addition, JP 06-289705 A discloses a device in which the diameter of a toner-supplying roller is designed to be larger than the diameter of a developing roller.

However, further improvements have been needed for the method for forming an image capable of effectively suppressing the toner deterioration due to rubbing and also capable of keeping the high quality image.

SUMMARY OF THE INVENTION

The present invention has been conducted in view of the above problems. An object of the invention is to provide a method for forming an image capable of suppressing a toner deterioration due to rubbing and also capable of keeping a high quality image for a long period of time even if the method is used in a downsized and high-speed apparatus having a high process speed.

Accordingly, the present invention provides a method for forming an image comprising the steps of:

charging a surface of a latent image bearing member;

forming an electrostatic latent image on the charged surface of the latent image bearing member;

developing the electrostatic latent image with a nonmagnetic one-component toner by a developing unit to form a toner image;

transferring the toner image to a transfer material with or without passing through an intermediate transfer body; and fixing the toner image on the transfer material, wherein the developing unit comprises:

a toner container for accommodating the nonmagnetic one-component toner;

a rotatable toner bearing member in a cylindrical shape for bearing the nonmagnetic one-component toner and transporting the toner to the latent image bearing member, which is provided in contact with the latent image bearing member;

a toner-supplying member for supplying the nonmagnetic one-component toner accommodated in the toner container to the toner bearing member, which is brought into contact with the surface of the toner bearing member at a position upstream of a contact position between the toner bearing member and the latent image bearing and is constructed of a rotatable elastic body in a cylindrical shape with a rotation axis in parallel to the rotation axis of the toner bearing member; and a toner regulating member for regulating the amount of the nonmagnetic one-component toner on the toner bearing member, which is brought into contact the toner bearing member through the nonmagnetic one-component toner, the following relational expression (1) is satisfied when the diameter of the toner bearing member is represented as Rd (mm) and the diameter of the toner-supplying member is represented as Rs (mm):

$$1 \leqq Rs - Rd \leqq 10 \quad (1)$$

the nonmagnetic one-component toner comprises a toner particle comprising a binder resin, a colorant, and a releasing agent, and an external additive, the addition amount of the external additive is 0.5 to 5.0 parts by mass with respect to 100 parts by mass of the toner particle, the external additive comprises a silica fine particle powder treated with a silicone oil, and the nonmagnetic one-component toner has a degree of aggregation of 5 to 30% and an electric resistivity of $1\times10^{14}$ to $1\times10^{18}$ Ω·cm at an electric field of $1\times10^{4}$ V/cm.

BRIEF DESCRIPTION OF THE DRAWINGS

Other objects and advantages of the present invention will become apparent during the following discussion conjunction with the accompanying drawings, in which.

DETAILED DESCRIPTION OF THE PREFERRED EMBODIMENT

Figure 1:
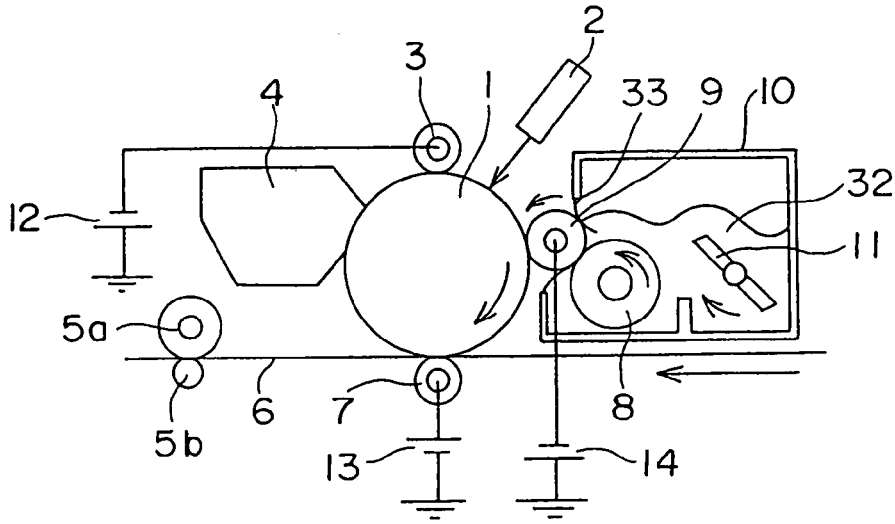
FIG. 1 is a schematic cross sectional diagram that shows an example of a structure of an image forming apparatus for suitably implementing the method for forming an image of the present invention.

For an method for forming an image using a nonmagnetic one-component developing process, the inventors of the present invention have found that the deterioration of toner particles can be favorable suppressed and a high quality image can be obtained when a relationship between a toner bearing member and a toner-supplying member satisfies predetermined conditions, and a toner having a moderate degree of aggregation and a moderate electric resistivity is used.

Hereinafter, the present invention is described in more detail.

In a developing unit, a frictional force is exerted on a toner at a contact potion between a toner bearing member and a toner-supplying member. The toner is electric charged by the frictional force, while an external additive is embedded in the toner particle or the toner becomes irregularly shaped.

As a resulting of extensive study, the inventors of the present invention have found that the stress exerted on the toner can be reduced by setting the diameter of a toner-supplying member larger than that of a toner bearing member, and thus toner deterioration caused by the rubbing between the toner and structural members (the toner bearing member and the toner-supplying member) can be suppressed.

In other words, in the present invention, there is a need of satisfying the following relational expression (1) when the diameter of the toner bearing member is represented by Rd (mm) and the diameter of the toner-supplying member is represented by Rs (mm).

$$1 \leqq Rs - Rd \leqq 10 \quad (1)$$

The diameter Rd of the toner bearing member and the diameter Rs of the toner-supplying member preferably satisfy the following relational expression (2), more preferably the following relational expression (3).

$$2 \leqq Rs - Rd \leqq 8 \quad (2)$$

$$3 \leqq Rs - Rd \leqq 6 \quad (3)$$

In addition, the diameter Rd of the toner bearing member and the diameter Rs of the toner-supplying member preferably satisfy the following expressions (4) and (5), respectively.

$$10 \leqq Rd \leqq 14 \quad (4)$$

$$12 \leqq Rs \leqq 17 \quad (5)$$

If the Rd or Rs value is too small, there is a need of increasing the rpm of the member for keeping the process speed constant. An increase in temperature of the member or the like may occur, which is not preferable. On the other hand, if the Rd or Rs value is too large, there is a need of decreasing the rotational speed of the member to keep the toner bearing member being supplied with an appropriate amount of the toner, and the degree of frictional charging to the toner becomes weakened. As a result, the deficient image quality may occur, which is not preferable. It is more preferable that the Rd or Rs satisfy the following expression (6) or (7).

$$10 \leqq Rd \leqq 13 \quad (6)$$

$$14 \leqq Rs \leqq 17 \quad (7)$$

Furthermore, it is preferable that the surface hardness of the toner bearing member be higher than that of the toner-supplying member. In this case, a particularly significant effect can be obtained with respected to the suppression of toner deterioration when the diameters of the toner bearing member and the toner-supplying member satisfy the above relationship. Under such a relationship, the contact area between the toner bearing member and the toner-supplying member becomes larger, so that the charge imparting ability to the toner may be enhanced, and the supply of the toner to the toner bearing member may be also improved.

The surface hardness of the toner bearing member is preferably in the range of 25 to 60 (ASKER-C), and also the surface hardness of the toner-supplying member is preferably in the range of 40 to 90 (ASKER-F).

On the other hand, the toner deterioration also depends on the degree of aggregation of the toner. The degree of aggregation of the toner is one indicator of flowability. The degree of aggregation of the nonmagnetic one-component toner of the invention is 5 to 30%, preferably 10 to 28%, more preferably 15 to 25%. When the degree of aggregation of the toner used in the present invention is in this range, the stress of rub applied between the toner bearing member and the toner-supplying member can be appropriately relieved, while the rub allows the toner to be moderately charged. If the degree of aggregation of the toner is less than 5%, the toner passes through the developing step without uniformly adhering to the toner bearing member and the toner-supplying member. Thus, a sufficient image density cannot be obtained when an image is formed, and also the toner may be undesirably scattered in the developing device. On the other hand, if the degree of aggregation of the toner exceeds 30%, the flowability of the toner is insufficient. Thus, the toner tends to clop (a space) between the toner regulating member and the toner bearing member, so that the developing process will be hardly progressed smoothly. Therewith, the toner tends to be rubbed between the toner regulating member and the toner bearing member or between the toner-supplying member and the toner bearing member for more than necessary, so that the toner will be deteriorated.

The degree of aggregation of a toner is measured as follows using a powder tester for a measuring apparatus (manufactured by Hosokawa Micron Corporation). In a measuring process, screens of 100 mesh (aperture of 150 μm), 200 mesh (aperture of 75 μm), and 390 mesh (aperture of 38 μm) are arranged on a vibrating table such that the screens are layered in the descending order of their aperture sizes from the above. Then, 5 g of a measuring target toner is mounted on the 100-mesh screen, followed by initiating a vibration at vibrational amplitude of 0.6 mm and a vibrating time of 15 seconds. After the vibration, the mass of the toner remained on each screen is measured and then the degree of aggregation of the toner is calculated from the following equation (8):

$$\text{Degree of aggregation} = \frac{\text{Mass of sample on 100-mesh screen}}{\text{Mass of total sample}} \times 100 + \frac{\text{Mass of sample on 200-mesh screen}}{\text{Mass of total sample}} \times 100 \times 0.6 + \frac{\text{Mass of sample on 390-mesh screen}}{\text{Mass of total sample}} \times 100 \times 0.2 \quad (8)$$

The degree of aggregation of a toner can be adjusted by suitably selecting a colorant or a charge-controlling agent to be incorporated in the toner, or suitably selecting the kind, amount or conditions of addition of an external additive, or the like.

The nonmagnetic one-compound toner used in the present invention is characterized in that the electric resistivity thereof is in the range of $1\times10^{14}$ to $1\times10^{18}$ Ω·cm in an electric field of $1\times10^{4}$ V/cm. A sufficient charge-imparting ability to a toner can be obtained when the toner having the degree of aggregation and the electric resistivity within their predetermined ranges described above is used in a developing unit with a defined relationship between the diameter of a toner bearing member and a toner-supplying member as described above. The electric resistivity of the toner is preferably in the range of $1\times10^{14}$ to $1\times10^{17}$ Ω·cm, more preferably in the range of $1\times10^{15}$ to $1\times10^{17}$ Ω·cm. If the electric resistivity of the toner is less than $1\times10^{14}$ Ω·cm, the toner hardly retains a sufficient amount of electrostatic charges in the developing unit used in the method for forming an image of the invention. In addition, if the electric resistivity of the toner is more than $1\times10^{18}$ Ω·m, the charge distribution of the toner may be uneven. In each of those cases, roughness on the image tends to be marked.

The electric resistivity of a toner is measured by the method described below. The toner used in the invention is in powder form, so that the electric resistivity of the toner varies depending on the conditions of the measurement.

Here, a toner sample of 0.3 to 1.0 g in weight is tap filled in a cylinder having a lower electrode of 5 mm in diameter and then an upper electrode of 15 mm in diameter is placed thereon. Then, the measurement is performed under a load of 350 g on a portion between the upper electrode and the lower electrode. The thickness of the sample is measured at this point, and then the voltages from 0 to 500 volts and from 500 to 0 volts are applied in increments of 100 volts across the electrodes. Then, an electric field is calculated from the resistance and thickness of the sample to be measured and the applied voltage to determine the electric resistivity of the sample in $1\times10^{4}$ V/cm.

Furthermore, the nonmagnetic one-component toner comprising a toner particle and one or more kinds of external additives, where the toner particle at least includes a binder resin, a colorant, and a releasing agent. The external additive includes one or more kinds of silica fine particles treated with silicone oil.

In the present invention, the sum of amounts of all external additives (the total addition amount thereof) to be externally added to the toner is 0.5 to 5.0 parts by mass, preferably 1.0 to 3.0 parts by mass, more preferably 1.5 to 2.5 parts by mass with respect to 100 parts by mass of the toner particles. If the total addition amount of the external additives is less than 0.5 parts by mass, the ability of imparting flowability to the toner particles is not sufficient. If the total addition amount exceeds 5.0 parts by mass, an image defect may occur as the external additive separated from the toner particle contaminates a toner regulating member, a toner bearing member, or a latent image bearing member. Therefore, the effects of the present invention cannot be exerted sufficiently, so that such an amount of the external additives less than 0.5 parts by mass or in excess of 5.0 parts by mass is not preferably.

Furthermore, one of the features of the toner used in the present invention is to comprise a silica fine particle treated with silicon oil as the external additive described above. The addition amount of the silica fine particles to the toner is preferably 0.5 to 3.0 parts by mass, more preferably 1.0 to 2.5 parts by mass with respect to 100 parts by mass of toner particles. By defining the addition amount of the silica fine particles to the toner within the above range, the stability of an image density and the stability of image quality will be kept good for a long time. In addition, the BET specific surface area of the silica fine particles is preferably in the range of 30 to 400 $m^2/g$. When the silica fine particles which have been surface treated with silicon oil are not used, the external additive tends to adhere on the toner bearing member to degrade the ability of the toner bearing member to impart charges onto the toner.

The nonmagnetic one-component toner according to the present invention may have other external additives as well as a silica fine particle treated with the above-described silicone oil. In the present invention, organic or inorganic fine particles that are generally well known as external additives can be used. Specific examples of the inorganic fine particles to be used include: metallic oxides such as aluminum oxide, titanium oxide (anatase type, rutile type, amorphous), strontium titanate, cerium oxide, magnesium oxide, chromium oxide, tin oxide, and zinc oxide; nitrides such as silicon nitride; carbides such as silicon carbide; metallic salts such as calcium sulfate, barium sulfate, and calcium carbonate; fatty acid metallic salts such as zinc stearate and calcium stearate; and carbon black. Examples of the organic fine particles to be used include: a homopolymer or copolymer of a monomer component to be used in a binder resin for toner such as styrene, acrylic acid, methyl methacrylate, butyl acrylate, or 2-ethylhexyl acrylate; and carbon fluoride. In addition, fine particles of the above-described polymer that are produced by an emulsion polymerization method and spray dry method can be used.

If necessary, a plurality of the fine particles can be used in combination. The above-described inorganic fine particles may have been, or may not have been hydrophobic treated. More preferably, the inorganic fine particles may be hydrophobed. In the case where the fine particles are hydrophobic treated, any one of a wet method and a dry method may be used. Examples of hydrophobing agents include a silane coupling agent, a titanium coupling agent, an aluminate coupling agent, a zirco-aluminium coupling agent, and silicone oil. The silane coupling agent is particularly preferably used for the above-described hydrophobic treatment agent for: a metallic oxide such as titanium oxide, aluminium oxide, strontium titanate, cerium oxide, or magnesium oxide; a nitride such as silicon nitride; a carbide such as silicon carbide; a metallic salt such as calcium sulfate, barium sulfate, or calcium carbonate; or carbon fluoride.

Among them, it is preferable to externally add titanium oxide to the toner. The specific surface area of the titanium oxide to be used is preferably 5 to 150 $m^2/g$. It is more preferably that titanium oxide having a specific surface area of 5 to 50 $m^2/g$ and titanium oxide having a specific surface area of 80 to 150 $m^2/g$ are used together. In such a case, at least titanium oxide having a specific surface area of 80 to 150 $m^2/g$ is preferably surface-treated with a silane coupling agent. The addition of titanium oxide having a specific surface area of 80 to 150 $m^2/g$ to the toner prevents the toner from becoming charged up and adhering to toner regulating member. Further, the effect of stabilizing a charging ability of the toner by adding the titanium oxide having a specific surface area of 5 to 50 $m^2/g$ to the toner. Therefore, by adding such titanium oxides to the toner, in the structure of the image forming apparatus like the present invention, which is susceptible to stress at the contact portion between the toner bearing member and the toner-supplying member, the toner deterioration can be suppressed.

Furthermore, out of the external additives to be used in the invention, the BET specific surface area of at least one kind of external additives is preferably 100 $m^2/g$ or less.

The toner particle, which is one of the constituents of the nonmagnetic one-component toner used in the present invention, includes at least a binder resin, a colorant, and a releasing agent. Those materials to be included in the toner particle are not particularly limited, and may be any of those conventionally used for toner in the art. In addition, the method of producing the toner and the toner particles in the present invention are not particularly limited, and may be any of those known in the art.

For instance, the method of producing the toner of the invention may be a pulverization method in which toner-constituting materials such as a binder resin, a colorant, a releasing agent, and optionally a charge-controlling agent are melt-kneaded using a pressure kneader, an extruder, a media disperser, or the like to obtain a kneaded product. After cooling, the kneaded product is pulverized using a jet mill or the like and the pulverized product is then classified to obtain toner particles, followed by externally adding the external additives described above to the toner particles. In the pulverization method, it is also possible to form a cross-linking component in the binder resin when compounds such as various metal complexes, which cause a cross-linkage at the time of kneading, are simultaneously added at the time of melt-kneading the resin.

The toner particles according to the present invention may have been surface modification treated. In particular, the surface modification treatment has a great effect in the case where toner particles are produced with a pulverization method. Examples of an apparatus for performing the surface modification treatment include: surface modification apparatuses applying a high-speed gas impact such as Hybridization System (manufactured by Nara Machinery Co., Ltd.), Criptron System (manufactured by Kawasaki Heavy Industries, Ltd.), and Innomizer System (manufactured by Hosokawamicron Corporation); surface modification apparatuses applying a dry mechano-chemical method such as Mechanofusion System (manufactured by Hosokawamicron Corporation) and Mechanomil (manufactured by Okada Seiko Co., Ltd.); surface modification apparatuses applying a wet coating method such as Dispacoat (manufactured by Nisshin Engineering) and Coatmizer (manufactured by Freund); and instantaneously-heat-treating apparatuses that perform instantaneous heat-treatment on toner particles such as Surfusion System (manufactured by Nippon Pneumatic Mfg. Co., Ltd.). Those may appropriately be used singly or in combination.

Alternatively, the method of producing the toner particles according to the present invention may adopt another technique such as a wet process in which a colorant, a charge-controlling agent, and so on are mixed and dispersed in a solution composed of a solvent and a binder resin, and the mixture is then introduced in an aqueous system and suspended or emulsified therein, followed by classifying and drying the product.

Furthermore, the method of producing the toner particles according to the present invention may preferably a suspension polymerization method. In this method, a polymerizable monomer composition is prepared by dissolving or dispersing a colorant, a releasing agent, and optionally other toner particle materials in a polymerizable monomer that constitutes a binder resin, and dispersing the monomer composition in an appropriate dispersing medium, followed by polymerizing the monomer composition using a polymerization initiator to obtain toner particles. When the suspension polymerization method is used for producing the toner in the present invention, the polymerizable monomer to be used may be a vinyl polymerizable monomer capable of carrying out a radical polymerization. The vinyl polymerizable monomer used may be a monofunctional polymerizable monomer or a polyfunctional polymerizable monomer.

Examples of the monofunctional polymerizable monomers include: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate, and 2-benzoyloxyethyl acrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate, and dibutylphosphate ethyl methacrylate; methylene aliphatic monocarboxylates; vinyl esters such as vinyl acetate, vinyl propionate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

Examples of the polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2' -bis (4-(acryloxy diethoxy) phenyl) propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacryalte, neopentyl glycol dimethacrylate, polypropylene glycol dimethacrylate, 2,2'-bis (4-(methacryloxy diethoxy) phenyl) propane, 2,2'-bis (4-(methacryloxy polyethoxy) phenyl) propane, trimethylolpropane trimethacrylate, tetramethylolmethane tetramethacrylate, divinylbenzene, divinylnaphthalene, and divinyl ether.

In the present invention, the monofunctional polymerizable monomer may be used singly or in combination with one or more other monofunctional polymerizable monomers. Alternatively, the monofunctional polymerizable monomer may be used in combination with a polyfunctional polymerizable monomer. The polyfunctional polymerizable monomer can be used as a cross-linking agent.

For polymerization initiators to be used in polymerization of the aforementioned polymerizable monomers, oil-soluble initiators and/or water-soluble initiators are used. Examples of the oil-soluble initiators include: azo compounds such as 2,2'-azobis isobutyronitrile, 2,2' -azobis-2,4-dimethyl valeronitrile, 1,1'-azobis (cyclohexane-1-carbonitrile), and 2,2'-azobis-4-methoxy-2,4-dimethyl valeronitrile; and peroxide-based initiators such as acetyl cyclohexyl sulfonyl peroxide, diisopropyl peroxycarbonate, decanoyl peroxide, lauroyl peroxide, stearoyl peroxide, propionyl peroxide, acetyl peroxide, t-butylperoxy-2-ethylhexanoate, benzoyl peroxide, t-butylperoxy isobutyrate, cyclohexanone peroxide, methyl ethyl ketone peroxide, dicumyl peroxide, t-butyl hydroperoxide, di-t-butyl peroxide, and cumene hydroperoxide.

Examples of the water-soluble initiators include ammonium persulfate, potassium persulfate, 2,2'-azobis (N,N'-dimethylene isobutyro amidine) hydrochloride, 2,2'-azobis (2-aminodinopropane) hydrochloride, azobis (isobutylamidine) hydrochloride, sodium 2,2'-azobisisobutyronitrile sulfonate, ferrous sulfate, and hydrogen peroxide. In the present invention, a well-known chain transfer agent, polymerization inhibitor, or the like may further be added for controlling the polymerization degree of a polymerizable monomer.

For a crosslinking agent to be used in the toner of the present invention, a compound having two or more polymerizable double bonds is used. Examples of such a compound include: aromatic divinyl compounds such as divynylbenzene and divinylnaphthalene; carboxylates each having two double bonds such as ethylene glycol diacrylate, ethylene glycol dimethacrylate, and 1,3- butanediol dimethacrylate; divinyl compounds such as divinyl aniline, divinyl ether, divinyl sulfide, and divinyl sulfone; and compounds each having three or more vinyl groups. Those compounds may be used singly or as a mixture.

The nonmagnetic one-component toner according to the present invention comprises a mold releasing agent, in the toner particle, which is a material having a low softening point. Examples of the mold releasing agent to be used in the toner of the present invention incude: polymethylene waxes such as a pararffin wax, a polyolefin wax, and a microcrystalline wax; amide waxes; higher fatty acids; long-chain alcohols; ester waxes; and derivatives thereof such as a graft compound and a block compound.

Furthermore, examples of the polymethylene waxes include: a low molecular weight alkylene polymer obtained by carrying out the radical polymerization of an alkylene at a high pressure or by polymerizing an alkylene using a Ziegler catalyst or other catalysts at a low pressure; an alkylene polymer obtained by thermal decomposition of a high molecular weight alkylene polymer; a product obtained by separating and purifying a low molecular weight alkylene polymer which is a by-product formed at the time of polymerizing an alkylene; and a polymethylene wax obtained by extracting and fractionating a specific component from a distillation residue of a hydrocarbon polymer obtained from a synthetic gas made of carbon monoxide and hydrogen by the AG method or a polymethylene wax obtained by extracting and fractionating a specific component from a synthetic hydrocarbon obtained by hydrogenating the above distillation residue. In each of those waxes, an antioxidant may be added.

The releasing agent to be used is preferably one having a linear alkyl group with 15 to 100 carbon atoms. The examples of such a compound include a linear alcohol, a linear fatty acid, a linear acid amid, and a linear ester, each of which has such a linear alkyl group; and a montan derivative having a linear methylene chain with 15 to 100 carbon atoms.

The amount of the releasing agent to be used is preferably 1 to 20 parts by mass, more preferably 3 to 20 parts by mass with respect to 100 parts by mass of a binder resin when toner particles are produced by a melt-kneading pulverization method. On the other hand, when the toner particles are directly produced in an aqueous medium using a polymerizable monomer composition, the amount of the releasing agent to be used is 1 to 30 parts by mass, more preferably 5 to 20 parts by mass with respect to 100 parts by mass of the polymerizable monomer. Consequently, the toner particle may contain 1 to 30 parts by mass, preferably 5 to 20 parts by mass of the releasing agent with respect to 100 parts by mass of the binder resin produced from the polymerizable monomer.

If the content of the releasing agent is less than 1 part by mass with respect to 100 parts by mass of the binder resin, a sufficient mold releasing effect of the wax cannot be obtained. As a result, it leads to contamination of the members of the image forming apparatus during continuous printing. If the addition amount of the releasing agent is more than 30 parts by mass, it is difficult to obtain the toner according to the present invention, which has the degree of aggregation described above.

In the toner produced by the polymerization method, compared with that produced by the dry toner production process using the melt-kneading pulverization method, the massive amount of the releasing agent is facilitated to be included inside the toner particle, so that the toner can contain the massive amount of the releasing agent in general. Thus, an offset-suppressing effect at the process of fixing can be enhanced.

In the nonmagnetic one-component toner of the present invention, the colorant is further contained in the toner particle. The examples of the colorant to be used for the toner according to the invention will be listed below, but the colorants are not limited to these exemplified.

As a black colorant, carbon black or one toned black using yellow, magenta, and cyan colorants is used.

For the yellow colorants, pigments and/or dyes as shown below may be preferably used. Examples of the pigments to be used include compounds represented by a condensed azo compound, an isoindolinone compound, an anthraquinone compound, an azo metal complex methine compound, and an allylamide compound. Specific examples of the pigments to be suitably used include C. I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 166, 168, 169, 177, 179, 180, 181, 183, 185, 191:1, 191, 192, 193, and 199.

Examples of the dyes include: C. I. Solvent Yellow 33, 56, 79, 82, 93, 112, 162, and 163; and C. I. Disperse Yellow 42, 64, 201, and 211.

Examples of the magenta colorant to be used include a condensed azo compound, a diketopyrrolopyrrole compound, anthraquinone, a quinacridone compound, a basic dye lake compound, a naphthol compound, a benzimidazolne compound, a thioindigo compound, and a perylene compound. Specific examples of the magenta colorant to be suitably used include: C. I. Pigment Red 2, 3, 5, 6, 7, 23, 48:2, 48:3, 48:4, 57:1, 81:1, 122, 146, 150, 166, 169, 177, 184, 185, 202, 206, 220, 221, and 254; and C. I. Pigment Violet 19.

Examples of the cyan colorant to be used include a phthalocyanine compound and derivatives thereof, an anthraquinone compound, and a basic dye lake compound. Specific examples of the cyan colorant to be suitably used include C. I. Pigment Blue 1, 7, 15, 15:1, 15:2, 15:3, 15:4, 60, 62, and 66.

These colorants may be used independently or in combination. In addition, they may be used in the state of a solid solution. The colorant to be used in the invention is selected in terms of hue angle, chroma, brightness, weatherability, transparency on an OHP sheet, and dispersibility inside the toner. The addition amount of the colorant is 1 to 20 parts by mass with respect to 100 parts by mass of the binder resin.

The toner particles used in the present invention may contain a charge-controlling agent. The following materials are those controlling the toner to be negative-charged. Examples thereof are shown below, but another compound may also be used. For example, an organometallic compound and a chelate compound are effective. In addition, the examples include a monoazo metallic compound, an acetylacetone metallic compound, an aromatic oxycarboxylic acid-based metallic compound, an aromatic dicarboxylic acid-based metallic compound, an oxycarboxylic acid-based metallic compound, and a dicarboxylic acid-based metallic compound. Moreover, the examples include: an aromatic oxycarboxylic acid, an aromatic monocarboxylic acid, an aromatic polycarboxylic acid, and metallic salts, anhydrides, and esters thereof; and phenol derivatives such as bisphenol. In addition, the examples include urea derivatives, metal-containing salicyclic acid-based compounds, metal-containing naphthonic acid-based compounds, boron compounds, quaternary ammonium salts, calixarenes, and resin-based charge-controlling agents.

The charge controlling agent to be used is 0.01 to 20 parts by mass, preferably 0.5 to 10 parts by mass with respect to 100 parts by mass of the binder resin.

When the toner used in the invention is produced by the polymerization method, a condensation resin may be added to the toner. The examples of such a resin will be listed below. However, the present invention is not limited to these resins, so that other resins may be used. The condensation resins include polyester, polycarbonate, a phenol resin, an epoxy resin, polyamide, cellulose, or the like. More preferably, polyester is desired in terms of the diversity of the material. The amount of the condensation resin to be used is preferably 0.01 to 20 parts by mass, more preferably 0.5 to 10 parts by mass with respect to 100 parts by mass of the binder resin.

The method of producing toner particles to be used in the invention may be any of methods known in the art, so that other methods except the one described above may be used. For instance, there is the production of toner particles by emulsion polymerization which is typified by a soap-free polymerization method by which toner particles are formed by direct polymerization in the presence of an aqueous polymerization initiator soluble in a monomer. In addition, examples of the methods include an interfacial polymerization method such as a microcapsule-manufacturing process, an in situ polymerization method, and a coacervation method. Furthermore, an interface assembly method of obtaining toner particles having desired particle diameters by aggregating at least one kind of fine particle as disclosed in publications such as JP 63-186253 A.

The toner to be used in the invention is preferably one having an average circularity of 0.970 to 1.000 measured by a flow-type particle image analyzer FPIA-1000 (manufactured by TOA Medical Electronics Co., Ltd.). In addition, the content of the toner particles having an average circularity of less than 0.950 is preferably 15% by number or less. Here, the phrase "average circularity" is an arithmetic mean of circularities obtained by the following equation:

$$\text{(Circularity)} = \text{(Peripheral length of equivalent circle)} / \text{(Peripheral length of particle projection image)}$$

In the above equation, the peripheral length of the particle projection image is the length of a profile line obtained by connecting edge points of a binarized particle image. In addition, the peripheral length of the equivalent circle is the length of periphery of a circle having the same surface area as that of the binarized particle image.

In the contact developing method, a toner layer is supported on the surface of a toner bearing member and is in contact with the surface of an electrostatic latent image bearing member, so that the toner layer is subjected to strong rubbing between the both members. Therefore, comparing with a non-contact developing method, the toner particles tend to be come flat and break. The toner particles having an average circularity of less than 0.970 tend to be come flat and break. When the tone particle is flattened or broken, the charging property of the toner particle changes. Thus, such a toner particle behaves differently from the normal toner particle at the time of development, resulting in a decrease in developing ability. In addition, the transfer efficiency of the toner can be improved by increasing the circularity.

There are several methods for measuring the particle diameter distribution of toner. In the present invention, a multisizer (manufactured by Beckman Coulter, Inc.) is used and connected to an interface and a personal computer for the outputs of number average distribution and volume average distribution. An electrolytic solution is prepared as a 1% NaC1 aqueous solution from a reagent grade sodium chloride. In the measuring method, 0.1 to 1 ml of a surfactant, preferably an alkylbenzene sulfonate is added as a disperant in 30 to 50 ml of the electrolytic aqueous solution, followed by the addition of 2 to 20 mg of a measuring sample. The sample-suspended electrolytic solution is subjected to a dispersion treatment for about 1 to 3 minutes on an ultrasonic disperser. Then, using the multisizer, the volume and number of toner particles are measured, and the volume distribution and number distribution of toner particles having 2 to 30 μm particle diameters are computed.

In the particle diameter distribution of toner particles, the weight average particle diameter of the toner particles is preferably 3 to 10 μm, more preferably 4.5 to 9 μm. In addition, the coefficient of variation represented by the equation below is preferably 5 to 20%. In this case, the toner particles have sharp particle diameter distribution, so that the charging can be uniformly carried out on the toner by a regulating member to improve the developing ability.

$$\text{Coefficient of variation (\%)} = \{(\text{Standard deviation based on weight})/(\text{Weight average particle diameter})\} \times 100$$

Hereinafter, the method for forming an image of the invention will be described with reference to the attached figures. FIG. 1 is a schematic cross-sectional diagram showing an embodiment of the structure of an image forming apparatus that suitably implements the method for forming an image of the invention. In FIG. 1, reference numeral 3 denotes a charging roller provided as a primary charging member for allowing a direct charging by contacting with a photosensitive drum 1 provided as a latent image bearing member. Reference numerals 12 to 14 denote a bias supplies, reference numeral 6 denotes a transferring material such as paper, reference numeral 7 denotes a transferring member, reference numeral 5*a* denotes a fixing heat roller, reference number 5*b* denotes a fixing pressure roller, and reference numeral 4 denotes a cleaner.

At first, the surface of the latent image bearing member (the photosensitive drum) 1 rotating in a direction of an arrow is charged by the primary charging member 3 (step of charging). In this embodiment, the primary charging member is a charging roller 3 mainly comprised of a central core metal and a conductive elastic layer formed on the outer periphery of the core metal. The charging roller 3 is abutted on the photosensitive drum 1 in the longitudinal direction thereof with a suppression force to allow the charging roller 3 to rotate in accordance with the rotation of the photosensitive drum 1. By the way, a bias supply 12 for charging the surface of the photosensitive drum 1 is connected to the charging roller 3.

As one preferable process condition at the time of using the charging roller 3, the contact pressure of the roller 3 is 0.05 to 5 N/cm. As an applied voltage from a bias supply 12, a direct-current voltage (DC) or a superimposed voltage obtained by superimposing an alternating-current (AC) voltage on the DC voltage may be used, but not particularly limited. When the applied voltage in which the AC voltage is superimposed on the DC voltage is used, the AC voltage is 0.5 to 5 dVpp, the AC frequency is 50 Hz to 5 kHz, and the DC voltage is ±0.2 to ±1.5 kV. In addition, when the DC current is used as an applied voltage, the DC voltage is ±0.2 to ±5 kV. In the invention, it is preferable to use an applied voltage only composed of a DC voltage.

Examples of the charging unit except the charging roller 3 include a charging blade and a conductive brush. Those contact-charging unit have advantages in that the unit do not require a high voltage, compared with a non-contacting corona charging, and reduce the amount of ozone generation. The material of each of the charging roller and the charging blade provided as a contact-charging unit is preferably a conductive rubber, and the surface of the conductive rubber may be provided with a mold releasing film. As the mold releasing film, a nylon resin, a polyvinylidene fluoride (PVDF), a polyvinylidene chloride (PVDC), or the like may be used.

After the charging step, the surface of the photosensitive drum being charged is exposed to a laser beam or the like from a light-emission element 2 to form an electrostatic latent image depending on an information signal on the photosensitive drum 1 (step of forming an electrostatic latent image). At a position where the photosensitive drum 1 and the developing roller 9 (a toner bearing member) are brought into contact with each other, the electrostatic latent image is developed (visualized) with a nonmagnetic one-component toner to form a toner image (step of developing).

In the method for forming an image of the invention, the toner bearing member may rotate in the same direction as the direction of rotation of the photosensitive drum or in the reverse direction at a portion facing to the photosensitive drum. When the toner bearing member rotates in the same direction, it is preferable that the peripheral speed of the toner bearing member be set as 1.05 to 3.0 times as high as the peripheral speed of the photosensitive drum.

When the peripheral speed ratio of the toner bearing member to the photosensitive drum is less than 1.05, the supply of a toner to the photosensitive drum may be insufficient and a good solid image may be hardly obtained. Furthermore, a peripheral speed ratio of more than 3.0 is not preferable because a mechanical stress causes the toner deterioration and the fixation of a toner to a toner bearing member, and furthermore such a ratio accelerates such disadvantages.

The photosensitive body as a latent image bearing member to be preferably used is a photosensitive drum or a photosensitive belt, which has a photoconductive insulating substance layer such as those of a—Se, CdS, $ZnO_2$, organic photoconductor (OPC), and a—Si (amorphous silicon). The binder resin in an organic photosensitive layer of the OPC is not particularly limited, but preferable is a polycarbonate resin, a polyester resin, or an acrylic resin because those have particularly excellent transferring abilities, and the fusion and the filming of the toner and an external additive hardly occurs. Furthermore, on the surface of the elastic layer of the photosensitive body, a surface layer obtained by dispersing lubricant fine particles having high lubricity and water repellency in any binder may be provided.

Although the lubricants are not particularly limited, preferable examples of the lubricants to be used include: fluorine compounds such as various fluorine rubbers, fluorine elastomers, fluorocarbon and polytetrafluoroethylene in which fluorine is bound to graphite, polyvinylidene fluoride, ethylene-tetrafluoroethylene copolymers, and tetrafluoroethylene/perfluoro alkyl vinyl ether copolymers; silicon-based compounds such as silicone resin particles, silicone rubbers, and silicone elastomers; polyethylene; polypropylene; polystyrene; acrylic resins; polyamide resins; phenol resins; and epoxy resins.

Furthermore, in the binder of the surface layer, a conductive agent may be suitably added for controlling resistance thereof. Examples of the conductive agents include various kinds of conductive inorganic particles, carbon black, an ionic conductive agent, a conductive resin, and a conductive particle dispersion resin.

Next, the step of developing to be used in the method for forming an image of the invention will be described. The step of developing to be used in the invention is a process in which an electrostatic latent image formed on the surface of the photosensitive drum 1 is visualized (developed) by a developing unit with the nonmagnetic one-component toner described above to form a toner image. A developing device provided as a developing unit to be used in the invention includes a toner container 10 for accommodating a nonmagnetic one-component toner 32, an agitating member 11 for agitating the toner accommodated in the toner container 10, a developing roller 9 provided as a toner bearing member for bearing the toner accommodated in the toner container 10 and transporting the toner to a photosensitive drum 1, an coating roller 8 as a toner-supplying member for supplying the toner accommodated in the toner container 10 to the developing roller 9, and a regulating member 33 for regulating the amount of the toner on the developing roller 9 and providing charges for the toner.

The developing roller 9 is connected to a developing bias supply 14. In addition, the coating roller 8 is also connected to a bias supply (not shown). If a negative-charge toner is used, the voltage is set as more negative than a developing bias. If a positive-charge toner is used, the voltage is set as more positive than the developing bias. The transferring member 7 is connected to a transferring bias supply 13 having reverse polarity to the photosensitive drum 1.

In the developing device to be used in the invention, the toner bearing member 9 has a cylindrical form and the surface thereof makes into contact with the surface of the photosensitive drum 1. Then, this toner bearing member 9 can rotate in the forward direction or in the reverse direction with respect to the rotating direction of the photosensitive drum 1.

In the method for forming an image of the invention, it is indispensable that the toner bearing member 9 and the surface of the photosensitive drum 1 provided as an electrostatic latent image bearing member make contact with each other. In other words, comparing with a non-contact developing system, a contact developing system supplies the toner directly on the surface of the latent image bearing member, so that a trouble such as scattering of toner to the image hardly occurs. Consequently, lines, characters, and so on can be printed with good reproducibility.

In the contact developing system, it is preferable to use an elastic roller having an elastic layer on the surface thereof as a toner bearing member 9, and thus one can adopt a method in which a developer is coated on the surface of the elastic roller to make into contact with the surface of the photosensitive drum 1. In this case, the development is carried out by the action of a developing bias supplied on the elastic roller (the toner bearing member) in contact with the surface of the photosensitive drum 1 through the toner. At this time, there is a need to provide the potential difference between the elastic roller and the photosensitive drum. Thus, for example, it is possible to utilize a method in which an electric field is maintained while suppressing the electric conduction between the elastic roller and the surface of the photosensitive body by controlling resistance of an elastic rubber, which consists of the elastic roller, to a medium resistance. Alternatively, it is possible to utilize a method in which an insulating thin layer is formed on the surface layer of the conductive roller to form the elastic roller. Furthermore, as a toner bearing member, it is possible to use a conductive resin sleeve consists of a conductive roller and an insulating material coated on the surface, facing to the surface of the photosensitive drum 1, of the conductive roller, or an insulating sleeve constructed such that a conductive layer is provided on the surface thereof, which does not face to the photosensitive drum. Furthermore, a rigid roller may be used as the toner bearing member 9 and a latent image bearing member may be a flexible product like a belt.

The hardness of the elastic roller to be used is preferably 25 to 60 (ASKER-C/load of 1 kg), more preferably 30 to 60. In addition, the volume resistivity of the toner bearing member is preferably in the range of around $10^2$ to $10^9$ Ω·cm. If the resistivity of the toner bearing member is lower than $10^2$ Ω·cm, for example when a pinhole or the like is formed in the surface of the photosensitive body, there is a fear in that an over-current may flow. On the other hand, if the resistivity of the toner bearing member is higher than $10^9$ Ω·cm, the toner tends to be excessively electrified (charge-up) by tribo electrification and tends to cause a decrease in image density.

Both a high image quality and a high durability can be attained when the surface of the toner bearing member 9 is configured to have a surface roughness Ra of 0.2 to 3.0 μm. The surface roughness Ra correlates with the toner-carrying ability and the toner-charging ability. If the surface roughness Ra of the toner bearing member 9 exceeds 3.0 μm, it becomes difficult to make a developer layer on the toner bearing member 9 thin and also difficult to improve the image quality because the charging property of the developer cannot be improved. The toner bearing member 9 having a surface roughness Ra of 3.0 μm or less is able to control the amount of the toner carried thereon and to form a thinner developer layer on the toner bearing member while increasing the number of times the toner bearing member and the toner are brought into contact with each other. Thus, the charging property of the toner is also improved, so that the image quality can be synergistically improved. On the other hand, if the surface roughness Ra of the toner bearing member is less than 2 μm, it becomes difficult to control the coating amount of the developer.

In the invention, the surface roughness Ra of the toner bearing member corresponds to a center line average of roughness, which is measured using a surface roughness measuring instrument (Surfcoder SE-30H, manufactured by Kosaka Laboratory Ltd.) according to JIS Surface Roughness (JIS B0601). Specifically, the surface roughness Ra of the toner bearing member is a value calculating by the following expression (9) by the micrometer (μm) when a 2.5-mm portion is extracted as a measurement length a in the direction of the central line from a roughness curve and the central line of the extracted portion is expressed by the X axis, the direction of vertical magnification is expressed by the Y axis, and the roughness curve is expressed by y=f(x).

$$Ra=1/a \int_o^a |f(x)\ \mathbf{51}\ dx \qquad (9)$$

A coating roller 8 provided as a toner-supplying member is an elastic roller having a cylindrical form with a rotation axis extending in parallel with the rotation axis of the toner bearing member. The coating roller 8 is arranged so as to contact with the surface of the toner bearing member on an upstream of the contact position between the toner bearing member and the photosensitive drum 1 in the rotating direction. It is preferable that the rotatable coating roller 8 rotates in the reverse direction to the rotating direction of the toner bearing member. Such a structure of the coating roller 8 allows the toner to be adhered on a developing roller 9. Also, in this case, the friction between the coating roller 8 and the developing roller 8 allows the toner 32 to be charged.

The amount of a toner coat on the developing roller 9 is regulated by a regulating blade 33 provided as a toner regulating member. The regulating blade 33 is in contact with the developing roller 9 through the toner layer. At this time, the contact pressure between the regulating blade 33 and the developing roller 9 is preferably in the range of 0.05 to 0.5 N/cm as a linear pressure in the direction along the generating line of the developing roller 9.

Furthermore, the term "linear pressure" means a pressure to be applied per length of the regulating blade 33. For instance, the line pressure is 1.2 N/m when the developing roller 9 is brought into contact with the blade 33 having a contact length of 1 m while applying a load of 1.2 N on the blade 33. If the line pressure is less than 0.05 N/cm, the uniform triboelectric charging becomes difficult in addition to the difficulty in control of the amount of toner coat. Therefore, it may result in progression of fogging, etc. On the other hand, if the line pressure is more than 0.5 N/cm, the toner particle receives an excessive load, so that the deformation of the toner particle, the toner fusion to the regulating blade 33 or the developing roller 9, and so on tend to occur, which is not preferable.

The free end of the regulating blade 33 may be of any shape. For example the free end preferably has a cross section of linear shape, or is any other shapes such as an L-shape having a bent portion near the tip or a shape having a spherically swollen portion near the tip.

In the present invention, an elastic toner regulating member such as the regulating blade 33 is preferably made of a material selected from materials capable of causing triboelectric charging suitable for charging the toner to a desired polarity. Examples of the material to be used include rubber elastic materials such as a silicon rubber, a urethane rubber, and NBR; synthetic resin elastic materials such as a polyethylene terephthalate; and metal elastic materials such as stainless steel, steel, and phosphor bronze. Alternatively, it may be made of a complex of those materials. Furthermore, such a toner regulating member may be a metal blade having rigidity or the like in addition to the elastic blade for applying the toner in a press-contact manner. Specifically, there is suitably used the toner regulating member (the regulating blade 33) prepared by adhering or coating a resin on or around a contact portion between the member and the developing roller 9 using a metal elastic body such as a stainless steel, steel, and phosphor bronze as a base material.

Furthermore, an organic or inorganic material may be added into the toner regulating member. Alternatively, in this case, such a material may be melt-mixed in the toner regulating member or may be dispersed therein. For instance, the charging property of the toner can be controlled by adding metal oxides, metal powder, ceramics, carbon allotropes, whiskers, inorganic fibers, dyes, pigments, surfactants, or the like. In particular, when the elastic body which construct the toner regulating member is a molded product of a rubber or a resin, a metal oxide fine powder such as silica, alumina, titania, tin oxide, zirconia or zinc oxide; carbon black; a charge-control agent to be generally used for a toner, and the like are preferably contained therein.

Moreover, the application of a DC voltage and/or an AC voltage on the toner regulating member imparts an effect of loosening the toner particles and also improves the coating property of the toner for forming the uniform thin layer on the toner bearing member and uniform charging property to attain a sufficient image density and a good image quality.

In the method for forming an image of the invention, furthermore, the method for forming an image permits a development faithful to a dot latent image by particularly combining with an exposure system that forms a digital latent image on the photosensitive drum 1 for suppressing the latent image from becoming disturbed.

A visualized toner image is transferred to a transfer material 6 by a transfer member 7 (step of transferring) and is then fixed by passing through the area between a heating roller 5*a* and a pressurizing roller 5*b* (step of fixing). As a unit for fixing a toner image under heat and pressure, a system for heat-fixing the toner image with a heater through a film may be used herein in addition to the heat-roller system, as described herein, having a basic structure composed of the heating roller 5*a* with a built-in heating element such as a halogen heater and the pressurizing roller 5*b* made of an elastic material in press-contact with the heating roller 5*a* by a pressurizing force. In addition, the apparatus shown in FIG. 1 performs a direct transfer from the photosensitive drum to the transfer material without using an intermediate transfer body. However, it may be constructed such that the transfer is carried out from the photosensitive drum to the transfer material through the intermediate transfer body.

A transfer residual toner remaining on the photosensitive drum 1 without being transferred is collected by the cleaner 4 having a cleaning blade to be contacted with the surface of the photosensitive drum 1, and then the photosensitive drum 1 is cleaned for a subsequent image-forming cycle.

Figure 2:
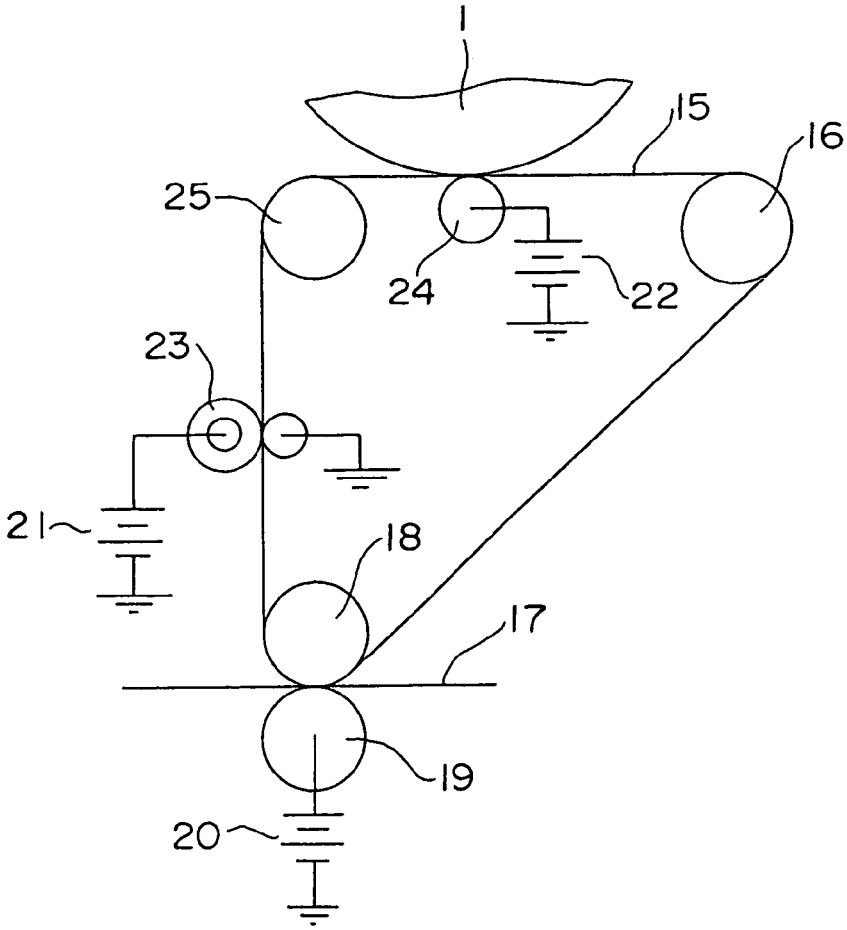
FIG. 2 is a schematic cross sectional diagram that shows an example of a partial structure of an image forming apparatus using an intermediate transferring belt for suitably implementing the method for forming an image of the present invention.

Next, description is made of the case in which an intermediate transfer belt is used as an intermediate transfer body in the step of transferring with reference to FIG. 2. In FIG. 2, reference numeral 15 denotes an intermediate transfer belt, reference numerals 16 and 25 each denote a roller for stretching the intermediate transfer belt 15, reference numeral 17 denotes a transfer material, reference numeral 24 denotes a primary transfer roller, reference numeral 19 denotes a secondary transfer roller, reference numeral 18 denotes a secondary transfer opposing roller, reference numerals 20 to 22 each denote a bias supply, and reference numeral 23 denotes a charging member for cleaning. Furthermore, the same members as those shown in FIG. 1 are denoted with the same reference numerals.

In FIG. 2, on the surface of the latent image bearing member (photosensitive drum) 1, electrostatic latent images corresponding to the toner images of the respective colors (first to fourth colors) for forming a full-color image are formed in sequence, respectively. Toner images can be obtained by sequentially developing the latent images with toners in the corresponding color by the publicly known color-developing device (not shown) capable of carrying out a development with toners in two or more colors.

In the process of passing through a nip portion between the photosensitive drum 1 and the intermediate transfer belt 15, the toner images formed and retained on the photosensitive drum 1 are sequentially transferred as a primary transfer on the outer peripheral surface of the intermediate transfer belt 15 by an electric field generated by a primary transfer bias being applied on the intermediate transfer belt 15 from the primary transfer roller 24. The primary transfer bias for sequentially transferring and superposing toner images in the first to fourth colors from the photosensitive drum 1 onto the intermediate transfer belt 15 has a polarity opposite to that of the toner and is then applied from a bias supply 22.

In the primary transfer step for transferring the toner images in the first to fourth colors onto the intermediate transfer belt 15, it is possible to allow the secondary transfer roller 19 and the charging member 23 for cleaning to separate from the intermediate transfer belt 15. The secondary transfer roller 19 is arranged on the lower surface of the intermediate transfer belt 15 in correspondence with the secondary transfer opposite roller 18 while being axially supported in parallel therewith and is arranged separably from the intermediate transfer belt.

The transfer (secondary transfer) of a composite color toner image obtained by sequentially transferring the toner images in the first to fourth colors on the intermediate transfer belt 15 to the transfer material 17 is carried out as follows. At first, when the secondary transfer roller 19 is brought into contact with the intermediate transfer belt 15, the transfer material 17 is fed to the contact nip between the intermediate transfer belt 15 and the secondary transfer roller 19 at given timing and subsequently a secondary transfer bias is applied from the bias supply 20 to the secondary transfer roller 19. Then, the secondary transfer bias permits the secondary transfer of the composite color toner image from the intermediate transfer belt 15 to the transfer material 17.

After the completion of the transfer of the composite color toner image to the transfer material 17, the charging member 23 for cleaning is brought into contact with the intermediate transfer belt 15 and subsequently a bias having the polarity opposite to the photosensitive drum 1 is applied thereto from the bias supply 21 to allow the toner being remained on the intermediate belt 15 (the transfer residual toner) without being transferred to the transfer material 17 to be provided with charges having polarities opposite to the photosensitive drum 1. Next, the transfer residual toner is transferred to the photosensitive drum 1 at or around the nip portion between the intermediate transfer belt 15 and the photosensitive drum 1 to clean the intermediate transfer belt 15.

The intermediate transferring belt 15 is composed of a base layer that is in the form of a belt and a surface-treated layer provided on the base layer. The surface-treated layer may consist of a plurality of layers. The base layer and surface-treated layer may be made of rubber, elastomer, or resin. The rubber and elastomer to be used may be one or more materials selected from the group consisting of a natural rubber, an isoprene rubber, a styrene-butadiene rubber, a butadiene rubber, a butyl rubber, an ethylene-propylene rubber, an ethylene-propylene terpolymer, a chloroprene rubber, a chlorosulfonated polyethylene, a chlorinated polyethylene, an acrylonitrile-butadiene rubber, a urethane rubber, a syndiotactic 1,2-polybutadiene, an epichlorohydrin rubber, an acrylic rubber, a silicone rubber, a fluorine rubber, a polysulfide rubber, a polynorbornene rubber, a hydrogenated nitrile rubber, and a thermoplastic elastomer (such as a polystyrene-based elastomer, a polyolefin-based elastomer, a polyvinyl chloride-based elastomer, a polyurethane-based elastomer, a polyamide-based elastomer, a polyester-based elastomer, or a fluorine-based elastomer). Note that the rubber and resin are not limited to those materials. Examples of the resin to be used include a polyolefin resin, a silicone resin, a fluorine resin, and polycarbonate. In addition, a copolymer or a mixture of those resins may be used.

Each of the above-described rubbers, elastomers, and resins is formed in the shape of a film to be used for a base layer. A core layer, which is in the form of a woven fabric, nonwoven fabric, yarn, or film, may have one or both surfaces coated, immersed, or sprayed with each of the above-described rubbers, elastomers, and resins.

A material constituting the core layer may be one or more materials selected from the group consisting of: natural fibers such as cotton, silk, hemp, and wool; regenerated fibers such as a chitin fiber, an alginate fiber, and a regenerated cellulose fiber; semisynthetic fibers such as an acetate fiber; synthetic fibers such as s polyester fiber, a nylon fiber, an acrylic fiber, a polyolefin fiber, a polyvinyl alcohol fiber, a polyvinyl chloride fiber, a polyvinylidene chloride fiber, a polyurethane fiber, a polyalkyl paraoxybenzoate fiber, a polyacetal fiber, an aramid fiber, a polyfluoroethylene fiber, and a phenol fiber; inorganic fibers such as a carbon fiber, a glass fiber, and a boron fiber; metallic fibers such as an iron fiber and a copper fiber. Of course, the material to be used is not limited to those compounds.

For controlling the resistance of the intermediate transferring belt 15, a conductive agent may be added to the base layer and the surface-treated layer. The conductive agent to be used may be, but not limited to, one or more materials selected from the group consisting of: carbon; metallic powder such as aluminium and nickel; metallic oxides such as titanium oxide; and conductive high molecular weight compounds such as quaternary ammonium salt-containing polymethyl methacrylate, polyvinyl aniline, polyvinyl pyrrole, polydiacetylene, polyethyleneimine, boron-containing high molecular weight compounds, and polypyrrole. Note that the conductive agent to be used is not limited to those materials.

For improving slidability and transfer property of the surface of the intermediate transfer belt 15, a lubricant may optionally be added. The lubricant is not particularly limited, but preferred examples thereof include: fluorine compounds such as a fluorine rubber, a fluorine elastomer, fluorocarbon and polytetrafluoroethylene in which fluorine is bound to graphite, polyvinylidene fluoride, an ethylene-tetrafluoroethylene copolymer, and a tetrafluoroethylene-perfluoro alkyl vinyl ether copolymer; silicon compounds such as a silicone resin, a silicon rubber, and a silicon elastomer; polyethylene; polypropylene; polystyrene; an acrylic resin; a polyamide resin; a phenol resin; and an epoxy resin.

Figure 3:
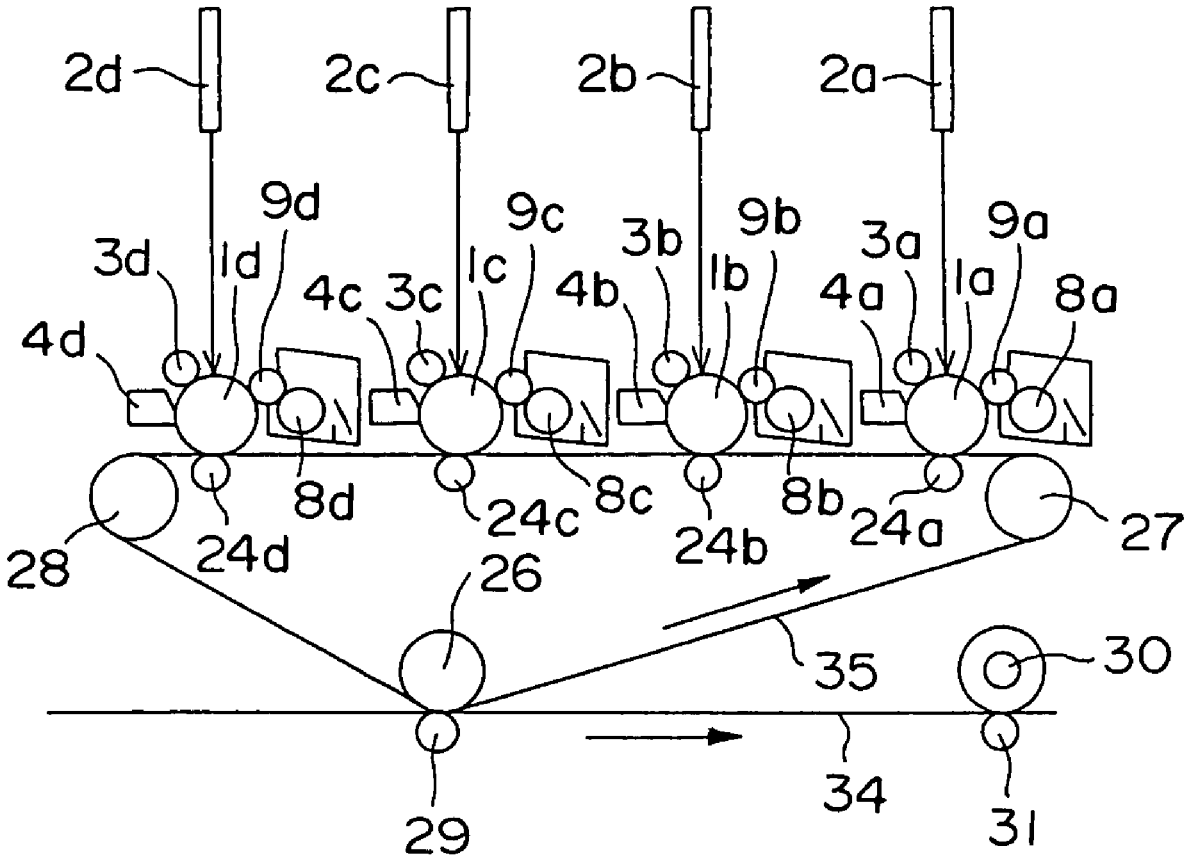
FIG. 3 is a schematic cross sectional diagram that shows an example of the structure of a tandem-type full-color image forming apparatus for suitably implementing the method for forming an image of the present invention.

Furthermore, another image forming apparatus with which the method for forming an image of the invention can be implemented is a full-color image forming apparatus as shown in FIG. 3.

In FIG. 3, each latent image bearing member (photosensitive drum) and each developing device are arranged in a tandem manner, i.e., in parallel to each other in the process-advancing direction (the rotating direction) of the intermediate transfer belt. In the image-forming apparatus of the present embodiment, around the photosensitive drums 1*a*, 1*b*, 1*c*, and 1*d*, developing devices having toner bearing members (developing rollers) 9*a* to 9*d* and toner supply members 8*a* to 8*d*, charging rollers 3*a* to 3*d*, latent image forming units 2*a* to 2*d*, transfer rollers 24*a* to 24*d*, and cleaning units 4*a* to 4*d* are arranged. The photosensitive drums, the developing devices, the charging rollers, the latent image forming units, and the cleaning units may be integrally formed and also they may form a process cartridge.

The primary transfer is carried out by applying a bias on each of the transfer rollers 24*a*, 24*b*, 24*c*, and 24*d*. Then, the bias will allow the first to fourth color toner images of the respective developing devices to be sequentially transferred and superposed on the intermediate transfer belt 35 from the photosensitive drums 1*a*, 1*b*, 1*c*, and 1*d*.

The transfer of a composite color toner image transferred on the intermediate transfer belt 35 to a transfer material 34 is carried out as follows. That is, the secondary transfer roller 29 is brought into contact with the intermediate transfer belt 35. Then, the transfer material 34 is fed at a predetermined timing to the contacting nip between the intermediate transfer belt 35 and the secondary transfer roller 29. Subsequently, a secondary transfer bias is applied on the secondary transfer roller 29 from the bias supply. The secondary transfer bias allows a composite color toner image to be secondary transferred from the intermediate transfer belt 35 to the transfer material 34. Note that, reference numeral 26 denotes a secondary transfer opposing roller. Denoted by 27 and 28 are rollers for stretching the intermediate transfer belt 35.

The composite color toner image transferred on the transfer material 34 is fixed on a transfer material when the transfer material passes through the area between the heat roller 30 and the pressure roller 31 to form a permanent image. Here, as means for heat and pressure fixing, a system for heat-fixing the toner image with a heater through a film may be used in addition to the heat-roller system with a basic structure including a heating roller 30 with built-in heating element such as a halogen heater and a pressurizing roller 31 made of an elastic body being pressure-contacted with the heating roller 30 by a pressurizing force.

Figure 4:
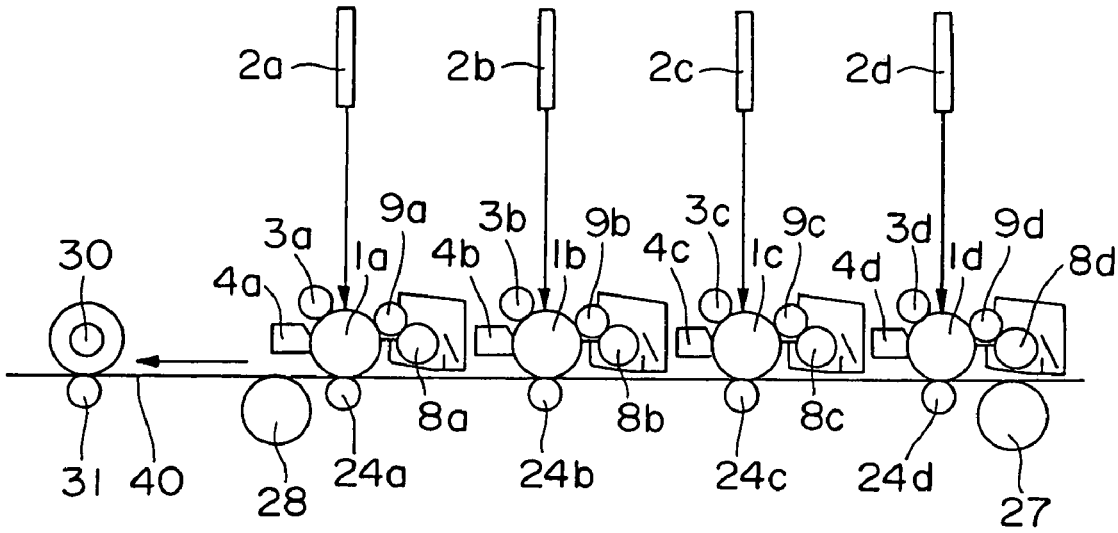
FIG. 4 is a schematic cross sectional diagram that shows another example of the structure of a tandem-type full-color image forming apparatus for suitably implementing the method for forming an image of the present invention.

FIG. 4 shows the image forming apparatus in which intermediate transfer belt shown in FIG. 3 is changed into conveying belt 40. In this apparatus, toner images are directly transferred on the transfer material, placed on the conveying belt 40 and conveyed thereby, at each of the developing units. Thus, the multiple color toner image is formed.

EXAMPLES

Hereinafter, the present invention will be described more specifically, but the invention is not construed to limit to these examples.

Production Example 1 for Toner Particle

In 400 parts by mass of ion-exchanged water, 450 parts by mass of a 0.1 mol/l $Na_3PO_4$ aqueous solution was introduced and the mixture was heated at 50° C., followed by agitating the mixture using a TK-type homomixer (manufactured by Tokushu Kika Kogyo, Co., Ltd.) at 10,000 rpm. Then, 68 parts by mass of a 1.0 mol/l $CaCl_2$ aqueous solution is added to obtain an aqueous medium containing calcium phosphate.

| | |
|---|---|
| (Monomer) | |
| Styrene | 75 parts by mass |
| n-butyl acrylate | 25 parts by mass |
| (Colorant) | |
| Yellow colorant (C.I. Pigment Yellow 180) | 6 parts by mass |
| (Charge-controlling agent) | |
| Aluminium di-tert-butylsalicylate compound | 1 part by mass |
| (Polar resin) | |
| Saturated polyester (Polycondensate of propylene oxide denatured bisphenol A and isophthalic acid, Tg = 70° C., Mw = 12,000, Mw/Mn = 2.4, acid value = 10) | 10 parts by mass |
| (Mold releasing agent) | |
| Behenyl stearate | 15 parts by mass |
| (Cross linking agent) | |
| Divinylbenzene | 1.2 parts by mass |

Above materials are uniformly dissolved and dispersed by using a TK-type homomixer (manufactured by Tokushu Kika Kogyo, Co., Ltd.) at 9,000 rpm. Then, 3 parts by mass of 2,2'-azobis (2,4-dimethyl valernitrile) was dissolved to obtain a polymerizable monomer composition.

The polymerizable monomer composition was introduced in the aqueous medium and then the mixture was agitated at 8,000 rpm using a TK-type homomixer under a nitrogen atmosphere at 50° C. to granulate the polymerizable monomer composition. Subsequently, the granulated composition was heated up to 60° C. for 2 hours, while agitating the composition with a paddle agitating blade, followed by reacting the mixture for 5 hours. After that, the mixture was heated up to 80° C. at a temperature rise rate of 40° C./hr and reacted for 5 hours. After the completion of the polymerization reaction, the remaining monomer was distilled off under reduced pressure, followed by addition of hydrochloric acid after cooling. Then, the mixture was stirred for 6 hours. After that, the steps of filtration, washing with ion-exchanged water, and drying were performed to yield a yellow toner particle 1. The yellow toner particle 1 had a weight average particle diameter of 6.8 μm and an average circularity of 0.989.

Production Example 2 for Toner Particle

A magenta toner particle 1 was produced using the same method as that of Production Example 1 for toner particle, except that the colorant was changed to a magenta colorant (C. I. Pigment Red 150). The magenta toner particle 1 had a weight average particle diameter of 6.7 μm and an average circularity of 0.985.

Production Example 3 for Toner Particle

A cyan toner particle 1 was produced using the same method as that of Production Example 1 for toner particle, except that the colorant was changed to a cyan colorant (C. I. Pigment Blue 15:3). The cyan toner particle 1 had a weight average particle diameter of 6.6 μm and an average circularity of 0.990.

Production Example 4 for Toner Particle

A black toner particle 1 was produced using the same method as that of Production Example 1 for toner particle, except that the colorant was changed to a carbon black and the additional amount thereof was changed to 10 parts by mass. The black toner particle 1 has a weight average particle diameter of 6.7 μm and an average circularity of 0.984.

Production Example 5 for Toner Particle

A yellow pulverized product was obtained by adding 5 parts by mass of an yellow colorant (C. I. Pigment Yellow 180), 3 parts by mass of an aluminium di-tert-butyl salicylate compound, and 11 parts by mass of a behenyl stearate to 100 parts by mass of a styrene-acrylic resin (Mn=7,200, Mw=42,000, THF insoluble content =13%, and glass transition temperature=58° C.) obtained by polymerizing styrene and n-butyl acrylate, and then melt-kneaded using a biaxial extruder, followed by grinding the mixture to obtain a yellow pulverized product. Then, heat and mechanical impacts were applied on the pulverized product using a surface modification apparatuses to reform the surface of the pulverized product, followed by subjecting the pulverized product to spherically-shaping treatment. The pulverized product subjected to the spherically-shaping treatment was classified using a multi-division classifier to obtain a yellow toner particle 2. The yellow toner particle 2 had a weight average particle diameter of 6.8 μm and an average circularity of 0.941.

Production Example 6 for Toner Particle

A magenta toner particle 2 was produced using the same method as that of Production Example 5 for toner particle, except that the colorant was changed to a magenta colorant (C. I. Pigment Red 150). The magenta toner particle 2 had a weight average particle diameter of 6.6 μm an average circularity of 0.937.

Production Example 7 for Toner Particle

A cyan toner particle 2 was produced using the same method as that of Production Example 2 for toner particle, except that the colorant was changed to a cyan colorant (C. I. Pigment Blue 15:3). The cyan toner particle 2 had a weight average particle diameter of 6.6 μm and an average circularity of 0.950.

Production Example 8 for Toner Particle

A black toner particle 2 was produced using the same methods as that of Production Example 5 for toner particle, except that the colorant was changed to a carbon black and the additional amount thereof was changed to 10 parts by mass. The black toner particle 2 had a weight average particle diameter of 6.9 μm and an average circularity of 0.942.

Example of Process Cartridge

A laser beam printer (an apparatus remodeling LBP-5500, manufactured by Canon Inc.) that utilizes an electrophotographic process in the type of a nonmagnetic one-component contact development system shown in FIG. 4 is used for forming images. The structure shown in FIG. 1, from which the transferring member 7, the bias supplies 12 to 14, the fixing heat roller 5*a* and the fixing pressure roller 5*b* was removed, was defined as a process cartridge. In this example modification as shown in the following items (a) to (h) was applied to the printer:

(a) A process speed was changed to 95 mm/s;

(b) As a charging method for the apparatus, a directed electrification was used, in which a rubber roller was brought into contact to electrostatic charging, and a direct current (−450 V) is used as an applied voltage;

(c) A toner bearing member was changed to an intermediate resistance rubber roller (12 mm in diameter, 45 in ASKER-C hardness, and $10^5\Omega\cdot$cm in resistance) made of a silicone rubber in which carbon black was dispersed, and was then brought into contact with the photosensitive drum;

(d) At the contact portion with the photosensitive drum, the toner bearing member was rotated in the same direction as that of the photosensitive drum at a peripheral speed of 135 mm/s;

(e) Each of the followings was used as a photosensitive drum. The photosensitive body was prepared by dip-coating the layers having the following structure on a Al cylinder provided as a base body to laminate the layers in order.

(1) A conductive coating layer: mainly comprising tin oxide and titanium oxide powders being dispersed in a phenol resin. The film thickness thereof was 15 μm.

(2) An under coating layer: mainly comprising modified nylon and copolymerized nylon. A film thickness thereof was 0.6 μm.

(3) A charge generating layer: mainly containing a titanyl phthalocyanine pigment having an absorption property in the longer wavelength region and being dispersed in a butyral resin. The film thickness thereof was 0.6 μm.

(4) A charge transport layer: mainly comprising a hole-transportable triphenylamine compound dissolved in a polycarbonate resin (a number average molecular weight Mn=20,000, measured by Ostwald viscometry) at a mass ratio of 8:10. The film thickness thereof was 20 μm.

Note that, the peripheral speed of the photosensitive drum was set as 95 mm/sec.

(f) As a toner-supplying member, an elastic roller made of a urethanefoam rubber (the number of cells was 50 to 100 cells per inch, ASKER-F hardness was 55, and the diameter was 16 mm) was used in the developing device and brought into contact with the toner bearing member. The elastic roller rotated in the direction opposite to that of the toner bearing member at the contact portion thereof with the toner bearing member. Here, the peripheral speed thereof was set as 95 mm/s.

(g) A stainless steel blade coated with a resin was used as a unit for controlling the coating layer of the toner on the toner bearing member (toner regulating member).

(h) A DC component (−250 to −300 V) only was used as the applied voltage at the time of development.

The remodeled apparatus uniformly charges the latent image bearing member using a roller charged (only applying a direct current). After the step of charging, the following steps wee performed. That is, an image portion was exposed to a laser beam to form an electrostatic latent image, followed by forming a visual image with the toner. Subsequently, the resulting toner image was transferred to a transfer material using a transfer roller on which a voltage is applied.

EXAMPLE 1

An external additive prepared based on an external additive formulation 1 shown in Table 2 was mixed with 100 parts by mass of each of the yellow toner particle 1, the magenta toner particle 1, the cyan toner particle 1, and the black toner particle 1, which were obtained in Production Examples 1 to 4 for toner particles respectively, using a Henschel mixer 10B (manufactured by Mitsui-Miike Machinery, Co., Ltd.) under the conditions of a rotation speed of 3,000 rpm and an agitating time of 4 minutes. Consequently, each color toner having negative triboelectric property was obtained. The degree of aggregation and the electric resistivity at an electric field of $1\times10^4$ V/cm of each resulting color toner are listed in Table 1, respectively.

170 g each of those color toners was filled in a developing device of the above described process cartridge, so that four color process cartridges could be obtained. These process cartridges were mounted on a full-color image forming apparatus shown in FIG. 4. Here, the description of the full-color image forming apparatus was given above.

A continuous printing test of 15,000 sheets of A-4 plain paper (75 g/m$^2$) was carried out in each environment of room temperature and room humidity (23° C./50% RH; N/N), low temperature and low humidity (15° C./10% RH; L/L), and high temperature and high humidity (30° C./80% RH; H/H). In this test, the printing speed was set as 16 sheets/minute calculated by A4 size with feeding direction of orthogonal to longitudinal direction. In addition, a print ratio of each color in the total area of the sheet was set to be 2%. An image after the completion of the test was evaluated with respect to roughness, generation of streaked incomplete image in a halftone image, and generation of fixation of toner on the basis of the evaluation method described below. The evaluation results are shown in Table 3 and Table 4, respectively.

In all of the examples and the comparative examples, the evaluation results at the initial stage of printing based on the following evaluation method were good.

[Evaluation Method]

(1) Roughness

The term "roughness" means a difference in tone on an image. After the completion of the continuous printing test of 15,000 sheets, of the totally solid image for each color was printed using the plain paper with sufficiently adjusted humidity in each test environment. At ten predetermined places in the image, the reflection density of the image was measured using a reflection densitometer "RD918" (manufactured by Macbeth, Co., Ltd.). Then, the difference between the average of five points with higher densities and the average of five points with lower densities was calculated and evaluated on the basis of the following criteria:

A: a density difference of 0.5% or less;

B: a density difference of more than 0.5 % and 1.0% or less;

C: a density difference of more than 1.0% and 1.5% or less;

D: a density difference of more than 1.5% and 2.0% or less; and

E: a density difference of more than 2.0%.

(2) Streaked Incomplete Image in a Halftone Image

After the continuous printing test for 15,000 sheets of paper, the whole halftone image of each color was printed using the plain paper with sufficiently adjusted humidity in each test environment. In the image, the number of white streaks having a width of 0.5 mm or less was counted and then each image was evaluated on the basis of the following criteria:

A: no white streak was found;

B: 1 to 3 white streaks were found;

C: 4 to 7 white streaks were found;

D: 8 to 10 white streaks were found; and

E: 11 or more white streaks were found or the generation of the white streak having a width of more than 0.5 mm was found.

(3) Observation of Fixation of Toner to a Toner Regulating Member

After the continuous printing test for 15,000 sheets of paper in the environment of room temperature and room humidity, the toner regulating member was observed and the degree of fixation of toner was evaluated on the basis of the following criteria:

A: no fixation of toner was found;

B: slight fixations of toner were found;

C: a few fixations of toner were found; and

D: many fixations of toner were found.

EXAMPLES 2 TO 7

A color toner was prepared in the same way as in Example 1, except that the formulation of the external additive to be added to toner particles of each color was replace by Formulations 2 to 6 and 10 of the external additive shown in Table 2. Then, the evaluation of the resulting toner was performed. Here, the degree of aggregation and the electric resistivity at an electric field of $1\times10^4$ V/cm of each resulting color toner are listed in Table 1 and the evaluation results thereof are listed in Tables 3 and 4, respectively.

Comparative Examples 1 to 3

A color toner was prepared in the same way as in Example 1, except that the formulation of the external additive to be added to toner particles of each color were changed to Formulations 7 to 9 of the external additive shown in Table 2. Then, the evaluation of the resulting toner was performed. Here, the degree of aggregation and the electric resistivity at an electric field of $1\times10^4$ V/cm of each resulting color toner was listed in Table 1 and the evaluation results thereof are listed in Tables 3 and 4, respectively.

TABLE 1

| | Toner particle | | Physical property of toner | | External |
|---|---|---|---|---|---|
| | Color | Production Example No. | Degree of aggregation [%] | Electric resistivity [Ω · cm] | additive formulation No. |
| Example 1 | Y | 1 | 12.8 | $3.0 \times 10^{15}$ | 1 |
| | M | 2 | 13.0 | $4.0 \times 10^{15}$ | |
| | C | 3 | 13.4 | $3.3 \times 10^{15}$ | |
| | Bk | 4 | 15.0 | $2.9 \times 10^{15}$ | |
| Example 2 | Y | 1 | 17.8 | $1.9 \times 10^{15}$ | 2 |
| | M | 2 | 16.5 | $2.1 \times 10^{15}$ | |
| | C | 3 | 18.2 | $1.5 \times 10^{15}$ | |
| | Bk | 4 | 17.7 | $1.7 \times 10^{15}$ | |
| Example 3 | Y | 1 | 9.1 | $1.0 \times 10^{16}$ | 3 |
| | M | 2 | 9.6 | $1.5 \times 10^{16}$ | |
| | C | 3 | 8.9 | $1.7 \times 10^{16}$ | |
| | Bk | 4 | 8.8 | $1.3 \times 10^{16}$ | |
| Example 4 | Y | 1 | 10.0 | $2.5 \times 10^{15}$ | 4 |
| | M | 2 | 11.2 | $2.9 \times 10^{15}$ | |
| | C | 3 | 13.5 | $3.5 \times 10^{15}$ | |
| | Bk | 4 | 9.8 | $3.0 \times 10^{15}$ | |
| Example 5 | Y | 1 | 14.1 | $3.3 \times 10^{15}$ | 5 |
| | M | 2 | 13.9 | $4.0 \times 10^{15}$ | |
| | C | 3 | 13.5 | $3.6 \times 10^{15}$ | |
| | Bk | 4 | 14.2 | $3.1 \times 10^{15}$ | |
| Example 6 | Y | 1 | 12.0 | $3.5 \times 10^{15}$ | 6 |
| | M | 2 | 13.5 | $4.0 \times 10^{15}$ | |
| | C | 3 | 14.1 | $3.7 \times 10^{15}$ | |
| | Bk | 4 | 12.1 | $3.2 \times 10^{15}$ | |
| Example 7 | Y | 1 | 10.7 | $6.5 \times 10^{15}$ | 10 |
| | M | 2 | 11.5 | $5.8 \times 10^{15}$ | |
| | C | 3 | 10.1 | $5.2 \times 10^{15}$ | |
| | Bk | 4 | 9.7 | $5.6 \times 10^{15}$ | |
| Comparative Example 1 | Y | 1 | 32.3 | $1.6 \times 10^{15}$ | 7 |
| | M | 2 | 31.4 | $2.1 \times 10^{15}$ | |
| | C | 3 | 33.6 | $2.3 \times 10^{15}$ | |
| | Bk | 4 | 34.0 | $1.8 \times 10^{15}$ | |
| Comparative Example 2 | Y | 1 | 4.3 | $1.8 \times 10^{18}$ | 8 |
| | M | 2 | 3.8 | $3.0 \times 10^{18}$ | |
| | C | 3 | 4.2 | $2.1 \times 10^{18}$ | |
| | Bk | 4 | 3.9 | $1.7 \times 10^{18}$ | |
| Comparative Example 3 | Y | 1 | 40.2 | $2.5 \times 10^{18}$ | 9 |
| | M | 2 | 39.8 | $2.3 \times 10^{18}$ | |
| | C | 3 | 44.3 | $3.0 \times 10^{18}$ | |
| | Bk | 4 | 45.6 | $1.2 \times 10^{18}$ | |

TABLE 2

| | External additive | | | | | |
|---|---|---|---|---|---|---|
| | Silica fine particle | Silica fine particle | Silica fine particle | Titanium oxide fine particle | Titanium oxide fine particle | |
| | Hydrophobic treatment | | | | | |
| | Isobutyltrimethoxysilane | Isobutyltrimethoxysilane | Hexamethyl-disilazane | — | Isobutyltrimethoxysilane | |
| | Oil treatment | | | | | |
| | Dimethyl silicone oil | Dimethyl silicone oil | Dimethyl silicone oil | — | — | Total amount of external |
| | BET one point method specific surface area | | | | | |
| | 180 $m^2/g$ | 130 $m^2/g$ | 50 $m^2/g$ | 15 $m^2/g$ | 100 $m^2/g$ | additive |
| External additive formulation 1 | — | 1.5 part | — | 0.05 part | — | 1.55 part |
| External additive formulation 2 | — | 1.2 part | — | 0.05 part | — | 1.25 part |
| External additive formulation 3 | — | 2.0 part | — | 0.05 part | — | 2.05 part |
| External additive formulation 4 | 1.5 part | — | — | 0.05 part | — | 1.55 part |
| External additive formulation 5 | — | — | 1.5 part | 0.05 part | — | 1.55 part |
| External additive formulation 6 | — | 1.5 part | 0.3 part | 0.05 part | — | 1.85 part |
| External additive formulation 7 | — | 2.0 part | — | 1.5 part | — | 3.50 part |
| External additive formulation 8 | — | 5.0 part | — | 0.05 part | — | 5.05 part |
| External additive formulation 9 | — | 0.4 part | — | 0.05 part | — | 0.45 part |
| External additive formulation 10 | — | 1.5 part | — | 0.05 part | 0.05 part | 1.60 part |

TABLE 3

| | Roughness | | | | | | | | | | | | |
|---|---|---|---|---|---|---|---|---|---|---|---|---|---|
| | Yellow | | | Magenta | | | Cyan | | | Black | | | Fixation |
| | N/N | H/H | L/L | N/N | H/H | L/L | N/N | H/H | L/L | N/N | H/H | L/L | of toner |
| Example 1 | A | A | A | A | A | A | A | A | A | A | A | A | B |
| Example 2 | A | A | B | A | A | B | A | A | B | A | A | A | B |
| Example 3 | A | A | A | A | A | B | B | A | B | B | B | A | B |
| Example 4 | A | B | A | A | B | A | A | A | C | A | A | B | B |
| Example 5 | A | A | B | A | A | B | B | A | B | C | A | B | B |
| Example 6 | A | B | A | A | B | A | C | A | C | B | A | B | B |
| Example 7 | A | A | A | A | A | A | A | A | A | A | A | A | A |
| Comparative Example 1 | B | C | B | B | B | C | B | D | C | B | D | D | B |
| Comparative Example 2 | B | C | D | C | D | C | B | D | C | C | D | D | C |
| Comparative Example 3 | C | D | D | B | D | D | C | D | D | C | D | D | D |

TABLE 4

| | Streaked incomplete image in halftone image | | | | | | | | | | | |
|---|---|---|---|---|---|---|---|---|---|---|---|---|
| | Yellow | | | Magenta | | | Cyan | | | Black | | |
| | N/N | H/H | L/L | N/N | H/H | L/L | N/N | H/H | L/L | N/N | H/H | L/L |
| Example 1 | A | A | A | A | A | A | A | A | A | A | A | A |
| Example 2 | A | A | A | A | B | A | A | B | A | A | B | A |
| Example 3 | A | A | A | A | A | B | A | A | B | B | B | A |
| Example 4 | B | B | A | B | B | A | A | A | A | A | A | B |
| Example 5 | A | A | B | B | A | B | A | A | B | B | A | B |
| Example 6 | B | B | A | B | B | A | B | A | A | B | A | B |

TABLE 4-continued

| | Streaked incomplete image in halftone image | | | | | | | | | | | |
|---|---|---|---|---|---|---|---|---|---|---|---|---|
| | Yellow | | | Magenta | | | Cyan | | | Black | | |
| | N/N | H/H | L/L | N/N | H/H | L/L | N/N | H/H | L/L | N/N | H/H | L/L |
| Example 7 | A | A | A | A | A | A | A | A | A | A | A | A |
| Comparative Example 1 | B | C | D | B | C | D | B | C | D | B | B | D |
| Comparative Example 2 | C | C | D | C | D | D | C | D | D | C | D | D |
| Comparative Example 3 | C | D | D | C | D | D | C | D | D | C | D | D |

Those examination results (Tables 3 and 4 ) show that an almost good image can be obtained in Examples 1 to 7. Then, using the toner of Example 1 as a standard, an influence of the difference between the diameter of the toner-supplying member and the diameter of the toner bearing member in the developing device on an image was investigated as follows.

EXAMPLE 8

In Example 1, the diameter of the developing roller 9 (the toner bearing member) in the developing device was changed to 14 mm and the diameter of the toner-supplying member 8 was changed to 16 mm. Here, only the diameter was changed such that materials, hardness, the number of cells, and the resistance values of the toner bearing member and the toner-supplying member were not changed. In addition, the image-forming conditions such as a process speed and an applied voltage at the time of development were not changed. Then, the color toners used in Example 1 were filled in such an image-forming apparatus and the evaluation with respect to roughness and generation of streaked incomplete image in a halftone image was carried out in the same way as in Example 1.

EXAMPLES 9 TO 13

The same evaluation as that in Example 1 was performed except that the diameter of the developing roller and the diameter of the toner-supplying member were changed as shown in Table 5, respectively. The evaluation results were listed in Tables 6 and 7, respectively.

Comparative Examples 4 to 10

The same evaluation as that in Example 1 was performed except that the diameter of the developing roller and the diameter of the toner-supplying member were changed as shown in Table 5, respectively. The evaluation results were listed in Tables 6 and 7, respectively.

TABLE 5

| | Diameter (Rd) of toner bearing member [mm] | Diameter (Rs) of toner-supplying roller [mm] | Rs − Rd |
|---|---|---|---|
| Example 8 | 14 | 16 | 2 |
| Example 9 | 14 | 15 | 1 |
| Example 10 | 10 | 17 | 7 |
| Example 11 | 8 | 17 | 9 |
| Example 12 | 7 | 12 | 5 |
| Example 13 | 9 | 18 | 9 |
| Comparative Example 4 | 18 | 18 | 0 |
| Comparative Example 5 | 13 | 13 | 0 |
| Comparative Example 6 | 5 | 17 | 12 |
| Comparative Example 7 | 14 | 12 | −2 |
| Comparative Example 8 | 14 | 10 | −4 |
| Comparative Example 9 | 15 | 11 | −4 |
| Comparative Example 10 | 16 | 10 | −6 |

TABLE 6

| | Roughness | | | | | | | | | | | |
|---|---|---|---|---|---|---|---|---|---|---|---|---|
| | Yellow | | | Magenta | | | Cyan | | | Black | | |
| | N/N | H/H | L/L | N/N | H/H | L/L | N/N | H/H | L/L | N/N | H/H | L/L |
| Example 8 | A | A | A | A | B | A | A | A | A | A | B | A |
| Example 9 | A | A | B | B | A | A | A | B | A | B | A | A |
| Example 10 | B | A | A | B | A | B | B | A | B | B | A | A |
| Example 11 | A | B | B | A | B | C | A | B | C | A | B | B |
| Example 12 | A | B | B | A | B | B | A | B | B | A | B | B |
| Example 13 | B | B | B | B | C | B | A | C | B | A | C | B |
| Comparative | B | B | C | B | C | B | B | C | B | B | B | B |

TABLE 6-continued

| | Roughness | | | | | | | | | | | |
|---|---|---|---|---|---|---|---|---|---|---|---|---|
| | Yellow | | | Magenta | | | Cyan | | | Black | | |
| | N/N | H/H | L/L | N/N | H/H | L/L | N/N | H/H | L/L | N/N | H/H | L/L |
| Example 4 | | | | | | | | | | | | |
| Comparative Example 5 | B | C | B | C | B | B | C | C | C | B | C | C |
| Comparative Example 6 | B | C | C | B | C | C | B | C | C | B | C | C |
| Comparative Example 7 | B | C | C | B | C | B | C | C | C | C | C | C |
| Comparative Example 8 | D | C | C | D | C | C | D | C | D | D | D | D |
| Comparative Example 9 | D | D | C | D | C | D | D | D | D | D | D | D |
| Comparative Example 10 | E | C | D | E | D | E | D | D | D | E | D | E |

TABLE 7

| | Streaked incomplete image in halftone image | | | | | | | | | | | |
|---|---|---|---|---|---|---|---|---|---|---|---|---|
| | Yellow | | | Magenta | | | Cyan | | | Black | | |
| | N/N | H/H | L/L | N/N | H/H | L/L | N/N | H/H | L/L | N/N | H/H | L/L |
| Example 8 | A | A | A | A | A | A | A | A | A | A | A | A |
| Example 9 | A | A | A | A | A | A | A | A | A | A | A | A |
| Example 10 | A | A | A | A | B | A | A | A | B | B | A | A |
| Example 11 | A | B | B | A | C | B | A | B | C | A | B | B |
| Example 12 | B | C | B | B | C | B | B | B | C | B | C | C |
| Example 13 | B | B | C | A | C | C | B | C | B | B | B | B |
| Comparative Example 4 | B | B | C | B | A | B | B | A | B | B | B | B |
| Comparative Example 5 | C | C | B | C | C | B | B | C | B | C | B | C |
| Comparative Example 6 | C | B | C | C | B | B | C | C | B | C | C | C |
| Comparative Example 7 | C | C | C | C | C | C | C | C | C | C | C | C |
| Comparative Example 8 | D | D | C | C | C | C | C | C | C | C | C | D |
| Comparative Example 9 | D | D | D | D | D | D | D | D | D | D | D | D |
| Comparative Example 10 | E | D | E | D | D | E | D | D | E | D | D | E |

What is claimed is;

1. A method for forming an image, comprising the steps of:

charging a surface of a latent image bearing member;

forming an electrostatic latent image on the charged surface of the latent image bearing member;

developing the electrostatic latent image with a nonmagnetic one-component toner by a developing unit to form a toner image;

transferring the toner image to a transfer material with or without passing through an intermediate transfer body; and fixing the toner image on the transfer material, wherein the developing unit comprises:

a toner container for accommodating the nonmagnetic one-component toner;

a rotatable toner bearing member in a cylindrical shape for bearing the nonmagnetic one-component toner and transporting the toner to the latent image bearing member, which is provided in contact with the latent image bearing member;

a toner-supplying member for supplying the nonmagnetic one-component toner accommodated in the toner container to the toner bearing member, which is brought into contact with the surface of the toner bearing member at a position upstream of a contact position between the toner bearing member and the latent image bearing and is constructed of a rotatable elastic body in a cylindrical shape with a rotation axis in parallel to the rotation axis of the toner bearing member; and a toner regulating member for regulating the amount of the nonmagnetic one-component toner on the toner bearing member, which is brought into contact the toner bearing member through the nonmagnetic one-component toner, the following relational expression (1) is satisfied when the diameter of the toner bearing member is represented as Rd (mm) and the diameter of the toner-supplying member is represented as Rs (mm):

$$1 \leqq Rs - Rd \leqq 10 \quad (1),$$

the nonmagnetic one-component toner comprises a toner particles comprising a binder resin, a colorant, and a releasing agent, and an external additive, the addition amount of the external additive is 0.5 to 5.0 parts by mass with respect to 100 parts by mass of the toner particle, the external additive comprises a silica fine particle treated with a silicon oil, and the nonmagnetic one-component toner has a degree of aggregation of 5 to 30% and an electric resistivity of $1\times10^{14}$ to $1\times10^{18}$ Ω·cm at an electric field of $1\times10^{4}$ V/cm.

2. The method for forming an image according to claim 1, wherein the diameter Rd of the toner bearing member and the diameter Rs of the toner-supplying member satisfy the following relational expression (2):

$$2 \leqq Rs - Rd \leqq 8 \quad (2).$$

3. The method for forming an image according to claim 1, wherein the diameter Rd of the toner bearing member and the diameter Rs of the toner-supplying member satisfy the following relational expression (3):

$$3 \leqq Rs - Rd \leqq 6 \quad (3).$$

4. The method for forming an image according to claim 1, wherein the diameter Rd of the toner bearing member and the diameter Rs of the toner-supplying member satisfy the following expressions (4) and (5), respectively:

$$10 \leqq Rd \leqq 14 \quad (4)$$

$$12 \leqq Rs \leqq 17 \quad (5).$$

5. The method for forming an image according to claim 1, wherein the addition amount of the external additive is 1.0 to 3.0 pats by mass with respect to 100 parts by mass of the toner particle.

6. The method for forming an image according to claim 1, wherein the addition amount of the silica fine particle treated with the silicone oil is 0.5 to 3.0 parts by mass with respect to 100 parts by mass of the toner particle.

7. The method for forming an image according to claim 1, wherein the external additive contains an external additive having a BET specific surface area of 100 $m^2/g$ or less.

* * * * *

UNITED STATES PATENT AND TRADEMARK OFFICE

CERTIFICATE OF CORRECTION

PATENT NO. : 7,067,225 B2
APPLICATION NO. : 10/753058
DATED : June 27, 2006
INVENTOR(S) : Shuntaro Watanabe et al.

It is certified that error appears in the above-identified patent and that said Letters Patent is hereby corrected as shown below:

Title page, item (75) INVENTORS: the fourth inventor's residence was misspelled and should be spelled as follows:

--Shinya YACHI, Shizuoka (JP)--

Signed and Sealed this

Twenty-first Day of November, 2006

JON W. DUDAS
*Director of the United States Patent and Trademark Office*